United States Patent [19]

Alheid

[11] Patent Number: 5,077,095

[45] Date of Patent: Dec. 31, 1991

[54] FLEXIBLE BLADE COATING ARRANGEMENT AND METHOD WITH COMPOUND BLADE LOADING

[75] Inventor: Robert J. Alheid, Roscoe, Ill.

[73] Assignee: Beloit Corporation, Beloit, Wis.

[21] Appl. No.: 525,504

[22] Filed: May 17, 1990

[51] Int. Cl.[5] ..... B05C 11/04

[52] U.S. Cl. ..... 427/356; 118/126; 118/413; 118/419

[58] Field of Search ..... 118/122, 126, 413, 419; 15/256.5, 256.51; 427/356, 358

[56] References Cited

U.S. PATENT DOCUMENTS

| | | | |
|---|---|---|---|
| 3,057,327 | 10/1962 | Faeber et al. | 118/413 |
| 3,255,038 | 6/1966 | Coghill | 118/126 |
| 4,880,672 | 11/1989 | Ericksson | 118/126 |
| 4,934,310 | 6/1990 | Wöhrle et al. | 118/413 |

*Primary Examiner*—Michael Wityshyn

*Attorney, Agent, or Firm*—Dirk J. Veneman; Raymond W. Campbell; David J. Archer

[57] ABSTRACT

Method and apparatus for applying a liquid film of controlled thickness to a paper web. The apparatus is in the form of a flexible blade coater having a flexible blade fixed at one end and bearing against a backing roll (with interposed web) at a free end. The blade has independent loading means, preferably pneumatic. An intermediate loading means applies a first load intermediate the fixed and free ends which serves primarily and substantially independently to establish blade geometry or tip slope. A second loading means positioned near the free end of the blade primarily and substantially independently establishes tip load for a given geometry established by the first loading means. The compound loading arrangement allows a wider range of finer control of coating film thickness.

8 Claims, 3 Drawing Sheets

FLEXIBLE BLADE COATING ARRANGEMENT AND METHOD WITH COMPOUND BLADE LOADING

FIELD OF THE INVENTION

This invention relates to papermaking, and more particularly to blade coaters for applying a liquid film of controlled thickness to a paper web.

BACKGROUND OF THE INVENTION

Blade coaters are utilized extensively in the papermaking industry for applying coatings to paper webs directly on the papermaking machine as well as in off-line coating operations. Blade coaters are desirable for their simplicity of construction and relative ease of control. A blade bears against a paper web carried through an application zone on a backing roll, the blade tip being at an exit point of a fluid reservoir. Controllable pressure brought to bear against the tip of the blade controls the thickness of the liquid film applied to the paper web as it leaves the application zone.

In a blade coater when arranged in the operative position for coating a paper web, one end of the blade is fixed in the coater apparatus and the other end is free, bearing against the web which rides on the backing roller. Loading means, such as a single elongate pneumatic tube, is positioned to bear against the blade in a position relatively near the blade tip. Pressure in the pneumatic tube thereby controls the force of the blade against the roll (as well as the blade geometry) and thereby controls the liquid film thickness applied to the web. It has been found that such control is not adequate for all purposes. More particularly, it has been found that the tip loading applied to a singly loaded blade has a substantial effect on both tip geometry and tip loading as the control alters the pressure exerted against the blade. As a result, film thickness is often not controllable over an adequate range. More significantly, even within the controllable range, the responsiveness of such a control is often found to be inadequate, both in terms of the linearity of the control as well as the control slope, i.e., the increment of film thickness adjustment which can be obtained for an increment of the control variable. Thus, in a system where a typical pneumatic tube is used to load the flexible blade, and pressure within that pneumatic tube is the sole running controllable variable, it is sometimes found that the range of control is inadequate and even more frequently it is found that the fine adjustments which are sometimes desired are not often achievable. This result follows because a slight change in pressure in the pneumatic tube can alter both the blade tip geometry and the tip load, to cause a relatively substantial change in film thickness for a relatively minor change in the control variable.

SUMMARY OF THE INVENTION

In view of the foregoing, it is a general aim of the present invention to provide a flexible blade coater which has a finer and broader range of control than the prior art discussed above.

In accomplishing that aim, an object of the present invention is to provide a flexible tip blade coater which substantially retains the mechanical simplicity of blade coaters of the prior art, but which provides independent control of blade tip geometry and blade tip loading.

In that respect, it is an objective to provide a method of operating such a flexible blade coater to provide a broad range of controlled coating thicknesses with fine incremental control of the thickness across the broad range.

Other objects and advantages will become apparent from the following detailed description when taken in conjunction with the drawings, in which:

While the invention will be described in connection with certain preferred embodiments, there is no intent to limit it to those embodiments. On the contrary, the intent is to cover all alternatives, modifications and equivalents included within the spirit and scope of the invention as defined by the appended claims.

DETAILED DESCRIPTION OF THE PREFERRED EMBODIMENTS

Figure 1:
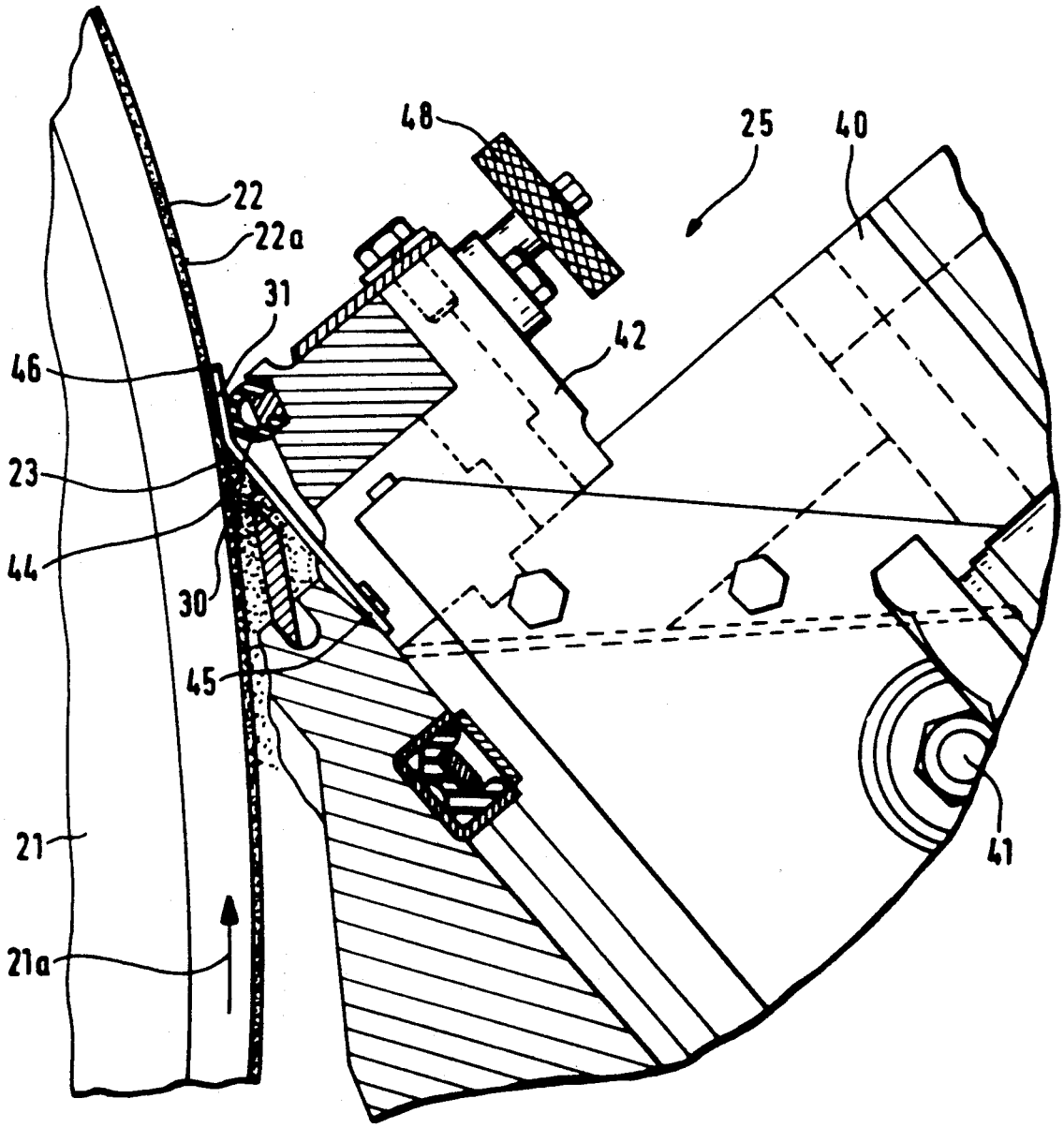
Fig. 1 (PRIOR ART)
FIG. 1 is a diagram illustrating a singly loaded flexible blade coater exemplifying a prior art approach to film thickness control.

Turning now to the drawings, FIG. 1 shows the main operative elements of a blade coating apparatus exemplifying the prior art. It is noted that the apparatus is shown with certain mounting brackets, end dams and the like removed so as to clearly illustrate the metering blade and loading arrangement for that blade.

More particularly, FIG. 1 shows a portion of a backing roll 21 carrying a paper web 22 through an application zone 23 of a blade metering device generally indicated at 25. A liquid reservoir 30 is supplied with liquid coating material, and a flexible blade 31 bears against the paper web 22 carried on the backing roll 21 to control the thickness of a film 22*a* of the liquid coating material which is applied to the surface of the web 22.

The details of the mounting arrangement for the blade coating device 25 are not important to an appreciation of the present invention, but it will be noted that the device is formed on a rigid bracket 40 mounted for pivoting about a pivot point 41. When the device is pivoted to the operative position shown in FIG. 1, the blade 30 is deflected near its tip, and the tip is loaded to control the film thickness applied to the web. Such loading is accomplished by an adjustable blade loading assembly 42 which carries an elongate pneumatic tube 44 running the length of the blade 31, and having a central chamber which can be controllably pressurized to adjust the amount of force applied to the blade. It is seen that the blade 31 has a fixed end 45 (fixed in the sense that it is not adjustable when the assembly 25 is rotated into the operative position) and a free end 46. Loading of the pneumatic tube 44, as will be described in detail below, establishes both the geometry of the blade 31 at its free end as well as the force applied to the blade in the area of contact with the web and backing roll 21. Thus, the amount of pressure applied to the tube 44 is a direct operational control over the film thickness 22 applied to the web 21. More specifically, as the backing roll 21 rotates in the direction of arrow 21*a*, liquid in the reservoir 30 is applied to the web and then wiped from the web by the blade 31, leaving only a thin film of liquid uniformly applied across the web under the control of the load 44 applied to the blade 31. The commercial implementation of such apparatus includes other elements which need be mentioned only in passing, because they are not important to the practice of the present invention. Such elements include mechanisms for mounting the various components, for disassembling the unit for cleaning, and as well as mechanical adjusting means 48 which is used to coarsely load the blade by mechanically positioning the tube 44 and the assembly which carries it. The pneumatic loading thereafter is the running control of film thickness applied to the web.

It will be appreciated that irrespective of the fact that both mechanical and pneumatic adjustments are provided, the blade 31 is loaded in only one position, the elongate line of contact between the blade 31 and the pneumatic tube 44. It has been found that a blade coating apparatus as illustrated in FIG. 1 is best operated with the blade loading device 44 positioned somewhat distantly from the free end 46 of the blade. As will be described below, with the blade thus positioned, an adjustment of the pressure applied to the tube serves to affect not only the blade geometry (the slope of the blade tip at the free end of the blade), but also the blade tip loading (the amount of force applied by the blade against the backing roll). Since both have an effect on film coating thickness, it has been found that the degree of control thus achieved, either with respect to the range of control or the fineness of control, is not always adequate.

In accordance with the invention, a flexible blade coater is provided having dual blade loading means, one of such means being adapted primarily to control the blade tip geometry at the free end of the blade, and the other of such loading means being adapted primarily to control the blade tip loading at its free end. Thus, the first loading means can be initially adjusted to establish the blade tip geometry, following which the second adjustment means is available for fine control of the blade tip loading without substantially affecting the blade tip geometry, thus providing a system with a wider range of control and fine and reasonably uniform control within the range.

Figure 2:
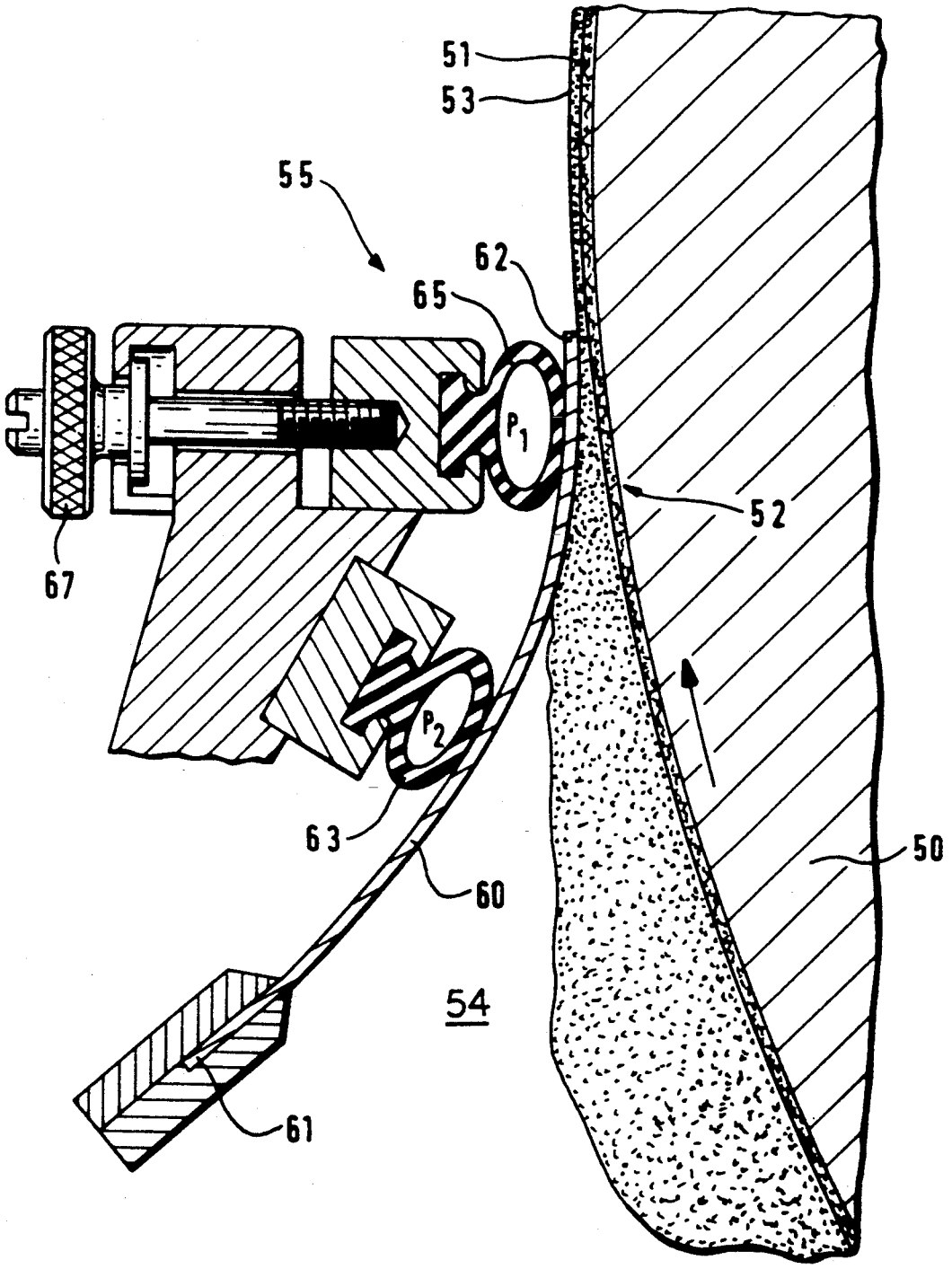
FIG. 2 is a diagram illustrating blade coater exemplifying the present invention.

A flexible blade coater exemplifying the invention is illustrated, partly in schematic, in FIG. 2. As in the FIG. 1 implementation, elements not essential to an illustration or understanding of the blade tip loading mechanism of the present invention are not shown in the drawing.

FIG. 2 shows a backing roll 50 for carrying a web 51 through an application zone 52 in which is applied a thin film 53 of liquid material from reservoir 54 is coated uniformly across the web under the control of a flexible blade metering device generally indicated at 55. It is seen that the metering device has a flexible blade 60 having a fixed end 61 which is anchored in supporting apparatus (not shown) and a free end 62 which is controlled by the adjustment mechanism, to be described below, for metering the thickness of the film 53.

In practicing the invention, the metering device 55 includes a first (or intermediate) loading means 63 which bears against the blade 60 at a position intermediate the fixed and free ends 61, 62 and a second (or tip) loading means 65, positioned near the blade tip. In comparing FIG. 2 and FIG. 1, it will be seen that the tip loading device 65 can be positioned much nearer the blade tip 62 than in the prior art, and the significance of that improvement will become more apparent in connection with the following description. Preferably, the first and second loading means 63, 65 are independently supplied from controllable pressurized fluid sources. In practice, after the original mechanical adjustment of the device is established by means of handwheel 67, and the arrangement is pivoted into the operative position shown in FIG. 2, the pressure is first adjusted in intermediate loading means 63 to establish the blade geometry, i.e., the slope of the blade with respect to a fixed reference at about the blade tip. After the pressure in intermediate loading means 63 is adjusted to establish the blade geometry, the coating film thickness is evaluated, and fine adjustment is made on the tip loading means 65 to achieve the desired coating thickness. If a more major adjustment is necessary, it may be desirable to first alter the blade geometry by an adjustment to intermediate loading means 63, following which a finer adjustment is possible in the thus established range by means of tip loading means 65.

It is believed that the enhancement of coating thickness control which is achieved by the present invention results in large measure from uncoupling the moment loading (which establishes blade geometry and is assigned primarily to the intermediate loading means) from force loading (which is exerted very near the blade tip and assigned primarily to the tip loading means). The theory which is believed to support this operation will be set forth below as an aid in understanding the functional advantages of the invention. However, it will also be apparent that the drawings and description above define the structure and mode of operating control of the invention adequately to allow one skilled in this art to practice the invention with or without an understanding of the functional theory.

Figure 3:
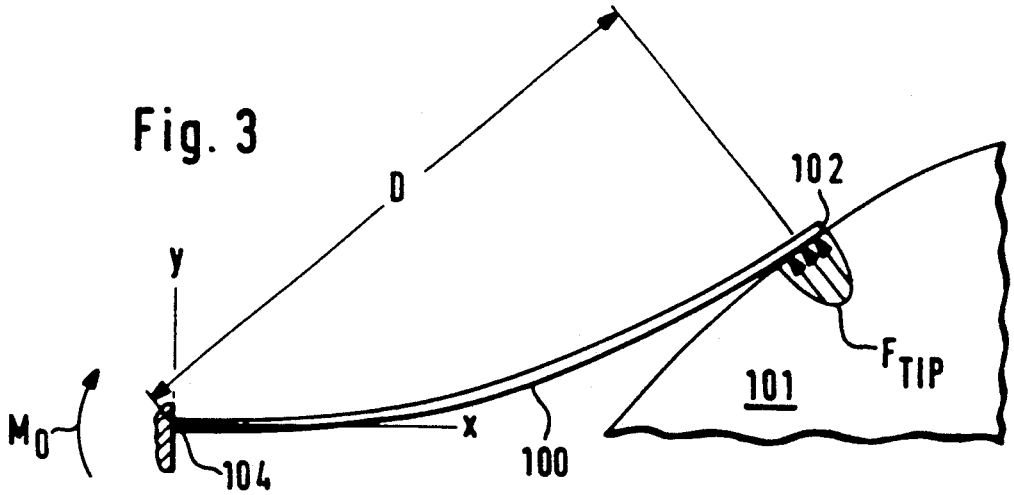
FIGS. 3–5 are diagrams illustrating the geometry of flexible loaded blades, which diagrams are useful in understanding the present invention.

FIGS. 3-6 illustrate the geometry of a bent blade coater useful in understanding the theory behind the present invention. FIG. 3 shows a flexible blade 100 bearing against a backing roll 101, but having no additional load on the blade, the sole force causing the blade tip 102 to bear against the roll 101 being a moment $M_0$ applied to the blade at its fixed end 104. FIG. 3 also shows an x-y coordinate system having its origin at the fixed end 104 of the blade, and having the x axis coincident with the blade slope at the $x=0$ origin. The coordinate system allows more specific reference to blade geometry, in that such geometry can be specified as the blade tip slope at the blade end, denoted herein as $(dy/dx)_{x=L}$, wherein, L is the length of the blade X is said to equal L for the above slope, but since the actual x dimension will be slightly less than L due to the blade curvature, it will be understood that only the approximation is intended. More particularly, the expression is intended to relate to the slope of the blade in a known coordinate system at about the point near the blade tip where the blade contacts the backing roll.

As noted above, FIG. 3 illustrates the situation with no intermediate or tip loads applied to the blade, the only load being the moment $M_0$ introduced by deflection of the blade as the blade carrying assembly is pivoted into its operative position. The tip load on the blade under such unloaded condition is thus defined by the expression:

$$F_{Tip}=M_0/D$$

where D is, as shown in FIG. 3, the linear distance between the origin of the coordinate system (the fixed end of the blade) and the point near the tip of the blade at which a resultant force would be applied equivalent to the distributed force occasioned by loading the blade end against the backing roll. In addition to considering the tip load, one also must consider the geometry of the blade at the blade tip which is defined as:

$$\left(\frac{dy}{dx}\right)_{x=L} = \left(\frac{dy}{dx}\right)_{Set\text{-}Up}$$

Figure 4:
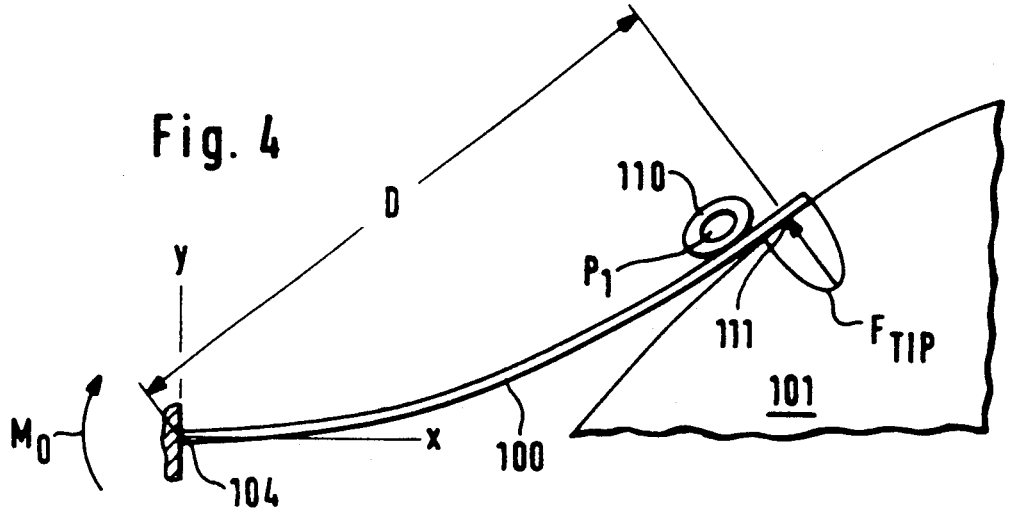

FIG. 4 illustrates the condition which is achieved in the practice of the prior art by applying a load on the blade near but not at the blade tip. It is seen that in the FIG. 4 illustration of the prior art, the external load applied to a pressure tube 110 is applied closer to the fixed end of the blade than the moment $M_0$ applied through lever arm D. It will thus be apparent that the force applied through external loading means 110 clearly affects not only the blade tip load (which opposes the blade contact force at about point 111), but also affects the geometry of the blade in introducing an additional blade bending moment.

Thus, the tip force in the system of FIG. 4 can be expressed by the following:

$$F_{Tip} = \frac{M_0}{D} + K\,P_1\,A_{Tube}$$

where K is a constant of proportionality relating the pressure in the tube 110 to a force applied to the blade, and $P_1$ and $A_{Tube}$ are the pressure within and area of the pressure tube 110. It will also be appreciated that using the arrangement of FIG. 4 the blade geometry is defined by:

$$\left(\frac{dy}{dx}\right)_{x=L} = \left(\frac{dy}{dx}\right)_{Set\text{-}Up} + K_1\,P_1\,A_{Tube}$$

where $K_1$ is a further constant of proportionality relating the force applied by the pressure tube to the deflection at the blade tip. It will thus be appreciated that any change in pressure $P_1$ which is intended to adjust the force at the tip in order to make a minor change in coating film thickness, will also adjust the blade geometry with potentially a much greater effect on film thickness than had been intended. It is this coupling of the tip load and blade moment in the prior art which is at least in substantial part responsible for the undesirable control characteristics of that system.

Figure 5:
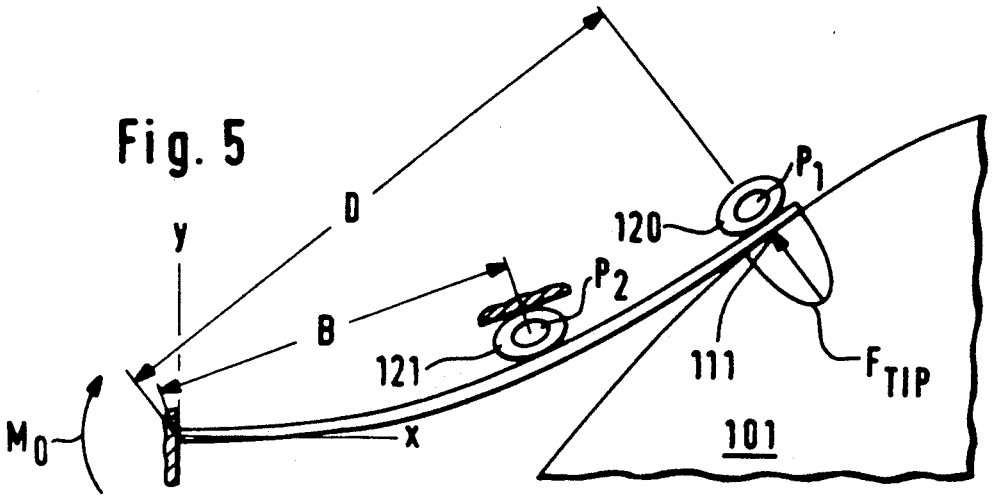

In practicing the invention, the geometry of FIG. 5 is utilized which provides a much greater measure of substantially independent control of blade geometry and tip load. Thus, in the system of FIG. 5, a tip tube or loading means 120 is positioned much nearer the blade tip than in the FIG. 4 illustration, such as at about the same distance D from the origin as the resulting load exerted by the backing roll against the blade. A second pressure tube 121 is also provided and is located intermediate the fixed and free ends of the blade, in the drawing at a distance B from the origin. For purposes of simplicity, the tubes 120, 121 are assumed to have the same area for the following computations, although the areas can be different when that is desired, and the manner in which the different areas affect the expressions will be apparent upon study of the following expressions by those skilled in this art.

Using the system of FIG. 5, the tip load can be expressed by the following:

$$F_{Tip} \approx \frac{M_0}{D} + P_2\,A_{Tube}\frac{B}{D} + P_1\,A_{Tube}$$

where $P_1$ and $P_2$ are the control pressures applied in tubes 120, 121, respectively. It will be seen from the foregoing expression that the pressure in the intermediate tube 121 has an effect on the tip force $F_{Tip}$, but that force is a fraction of the force caused by in tube 120 because of the ratio of moment arms B/D, a ratio which can be held at about 0.5 or less. Thus, the effect on tip force of pressure applied to the tip tube 120 can have at least twice the effect as any change in pressure applied to intermediate tube 121.

Even more significantly, the pressure in tip tube 120 has very little effect on blade geometry as will be appreciated from the following expression:

$$\left(\frac{dy}{dx}\right)_{X=L} \approx \left(\frac{dy}{dx}\right)_{Set\text{-}Up} + K_2\,P_1\,A_{Tube} + K_3\,P_2\,A_{Tube}$$

where $K_2$ is a constant relating the change in pressure in tip tube 120 to a change in geometry and $K_3$ is a proportionality constant relating a change in pressure in intermediate tube 121 to blade geometry. It will be appreciated from the FIGS. 4 and 5 illustrations, which shows the relative positions of the tubes with respect to the tip, that $K_2$ is much less than $K_1$ of the FIG. 4 embodiment, and substantially less than $K_3$ because of the relative lengths of the moment arms involved.

Thus, it will be seen that any pressure changes in intermediate tube 121 (i.e., changes in pressure $P_1$) will have only a minor effect on $(dy/dx)_{x=L}$ whereas the changes in pressure $P_2$, because of the substantially larger proportionality constant $K_3$ will have a controlling effect. As a result, it will be appreciated that the tip load and blade moment are substantially uncoupled, with the tip load being primarily controlled by pressure $P_1$ coupled to tip tube 120 and the blade moment or blade geometry being substantially controlled by pressure $P_2$ applied to intermediate tube 121.

With the foregoing geometrical and mechanical relationships in mind, referring again to FIG. 2, it will be seen that the invention provides a blade coating device having a flexible blade 60 fixed at one end 61 and a free end 62 which bears against a backing roll 50. The blade loading device 55 has two force applying means, an intermediate loading means 63 which bears against a portion of the blade intermediate the fixed and free ends, and a second loading means 65 which bears against the blade very near its tip. In setting up the apparatus, after the fountain assembly is pivoted into its operative position and any mechanical adjustments made, pressure is applied to the loading means and the pressure in the intermediate tube 63 is adjusted to achieve the appropriate blade geometry $(dy/dx)_{x=L'}$, where x=L for the coating thickness and material in question. L' is the appropriate blade geometry. After a rough adjustment is achieved by means of intermediate tube 63 setting the blade geometry, the adjustment is fine tuned by means of adjusting pressure in tip loading tube 65. The adjustment is finely controlled because the pressure variations in the tube 65 can directly affect the force applied by the blade tip 62 against the backing roll 52 without substantially changing the blade geometry which has been established by the intermediate loading tube. The fineness of control will thus be appreciated.

If upon initial setup it is determined that the coating thickness being achieved is substantially different from that desired, an initial adjustment can be made to alter the blade geometry by means of an adjustment of intermediate tube 63 to achieve a rough adjustment, then fine-tuning can be accomplished by adjusting the tip load by means of tip tube 65, such fine adjustment affecting primarily tip force but without changing tip geometry.

While it is preferred that the pressure sources for the separate tube 63, 65 be supplied independently, in some cases it may be desirable to couple such pressures and run one, for example, as a fraction of the other, so that making one adjustment will, at least in the first instance, have an effect on the other. In most cases, however, final fine tuning adjustment will be by means of adjusting tip pressure by tip tube 65 alone.

It will now be appreciated that what has been provided is an improved blade coater and method of coating moving webs with a uniform liquid film. In contrast to prior approaches, a flexible blade is utilized which is multiply loaded, one of the loading means primarily affecting blade tip geometry substantially independently of tip force, and the other loading mechanism being primarily responsible for adjusting blade tip force but without substantial effect on blade geometry.

What is claimed is:

1. In a blade coater for applying a liquid coating to a paper web in an application zone of the coater, the combination comprising:

a backing roll for carrying a web through an application zone, a flexible blade having a fixed end and a free end, the free end bearing against the web and backing roll for controlling the coating thickness, first loading means intermediate the blade ends for loading the blade primarily to control blade geometry, and second loading means near the blade free end for loading the blade primarily to control tip load.

2. The combination as set forth in claim 1 wherein the respective loading means comprise separate pneumatic tubes, the first loading means comprising a first pneumatic tube for primarily controlling blade tip slope, the second loading means comprising the second pneumatic tube for primarily controlling blade tip load.

3. The combination as set forth in claim 1 wherein blade tip slope and blade tip load are substantially uncoupled and responsive to the respective loading means.

4. In a blade coater applying a liquid coating to a paper web in an application zone, the combination comprising:

a backing roll for carrying a web through an application zone, a flexible blade having a fixed end and a free end, the free end bearing against the web and backing roll for controlling the coating thickness, a first pneumatic loading means bearing on the blade intermediate the fixed and free ends, a first pressurized pneumatic source for controlling the pressure applied to the intermediate section of the blade by the first pneumatic means, and a second pneumatic loading means bearing on the blade near the free end thereof, a second pressurized pneumatic source for controlling the pressure applied to the tip of the blade by the second pneumatic means.

5. The combination as set forth in claim 4 wherein the first pneumatic loading means comprises means primarily directed to adjusting blade tip slope, and the second pneumatic loading means comprises means for primarily controlling blade tip load.

6. A method of controlling the thickness of a liquid film applied to a paper web in an application zone of a blade coater, the blade coater having a backing roll and a flexible blade bearing against the web supported on the backing roll, the method comprising the steps of:

disposing the blade in an operating position having a first end fixed with respect to the coater and a free end disposed against the backing roll, loading the blade intermediate the fixed and free ends to establish a blade geometry, and independently loading the blade at a tip of the blade to establish for a given blade geometry a tip load for controlling the film thickness applied to the web.

7. The method as set forth in claim 6 wherein the step of loading the blade intermediate the fixed and free ends establishes the slope of the blade at the blade tip.

8. The method as set forth in claim 7 wherein establishing the tip load for a given blade geometry is accomplished substantially independently of alterations in the blade tip slope.

* * * * *